United States Patent [19]

Rozner et al.

[11] Patent Number: 4,495,848

[45] Date of Patent: Jan. 29, 1985

[54] PYRO-GUN

[75] Inventors: Alexander G. Rozner, Potomac; Daniel S. Lenko; James H. Carter, both of Silver Spring, all of Md.

[73] Assignee: The United States of America as represented by the Secretary of the Navy, Washington, D.C.

[21] Appl. No.: 285,174

[22] Filed: Jul. 6, 1981

[51] Int. Cl.[3] ..... B23K 7/10; F23Q 7/12

[52] U.S. Cl. ..... 89/1.1; 42/84; 102/220; 266/66; 431/256

[58] Field of Search ..... 42/84, 1 R; 89/1 B, 89/1 R; 102/335, 220, 218; 266/48, 66, 77; 431/91, 127, 128, 256, 258, 254, 255

[56] References Cited

U.S. PATENT DOCUMENTS

| | | | |
|---|---|---|---|
| 3,225,695 | 12/1965 | Kapp et al. | 102/220 |
| 3,427,924 | 2/1969 | Johnsen | 42/84 |
| 3,618,525 | 11/1971 | Fritz | 102/220 |
| 3,713,636 | 1/1973 | Helms et al. | 102/335 |
| 3,734,476 | 5/1973 | Holzman | 266/48 |
| 3,864,862 | 2/1975 | Brunger et al. | 42/84 |
| 3,878,790 | 4/1975 | Meyer | 102/220 |

OTHER PUBLICATIONS

Rosenthal, Louis A.; "Novel Electroexplosive Device Firing Method"; Review Scientific Instrumentation; Mar. 1974; p. 450.

*Primary Examiner*—Charles T. Jordan

*Attorney, Agent, or Firm*—Robert F. Beers; Kenneth E. Walden; John C. LaPrade

[57] ABSTRACT

A hand held, shoulder mounted gun with time delay circuitry means to safely ignite a powdered pyrotechnic material.

9 Claims, 2 Drawing Figures

PYRO-GUN

BACKGROUND OF THE INVENTION

Pyronol and other mixtures of metal oxides, with powdered metals that burn at extremely high temperatures have been known and have been patented for several years. The basic patents on the pyrotechnic compositions of a mixture of powdered metals and metal oxides issued to Dr. Alexander G. Rozner et al. are U.S. Pat. Nos. 3,503,814; 3,695,951; 3,713,636 and 3,890,174. Through the disclosure of the composition of these mixtures in one or more of the above identified U.S. patents it has been known to formulate pyrotechnic compositions of powders of mixtures of aluminum, metal oxides and metals selected from the group consisting of iron, copper, silver, niobium tungston, molybdenum or other metals mixtures as set forth in U.S. Pat. No. 3,695,951.

In the ignition and firing of these high temperature burning powders it has been standard practice to utilize electrical cables to ignite the mixtures (Pyronol) at considerable distances so as to insure safety to the operator. Prior to the practice of the instant invention no hand held or shoulder mounted device was capable of safely igniting the powdered metal and oxide mixtures of the pyrotechnic compositions.

SUMMARY OF THE INVENTION

The invention is a safe shoulder mounted hand held torch or gun used to ignite a mixture of metal oxides or other equivalent pyrotechnic composition that is capable of being ignited to burn at very high temperatures.

In the past ignition of these pyrotechnic compositions that include pyronol and thermite (R) have been initiated through electrical wiring connected to a power source remotely located with relationship to the pyrotechnic composition.

In the present invention great safety is built into the operation of the gun through an independent arming switch means and circuit and a secondary manually operated fire switch means and circuit that delivers ignition current to the chamber in the gun where the pyrotechnic composition is held prior to firing.

In the arming circuit, when the manually operated arm switch is actuated a capacitor is charged for a few seconds to build up a certain predetermined charge. Upon subsequent actuation of a manual fire switch, a secondary circuit controlled by a silicon-controlled rectifier delivers ignition current previously stored in the capacitor means to an igniter chamber in the forward end of the gun.

OBJECTS OF THE INVENTION

It is one object of the invention to provide a shoulded fired torch that is capable of safely igniting a pyrotechnic composition.

It is therefore, the principal object of the invention to provide a hand held gun for igniting powdered incendiary material that is completely safe.

It is another object of the invention to provide a hand held torch that is reliable for igniting powdered incendiary material.

It is an additional object of the invention to provide a hand held ignition torch that is easy to use.

It is one other object of the invention to provide a small portable hand held torch for igniting powdered incendiary material.

It is a still further object of the invention to provide a hand held torch or gun for igniting powdered incendiary material, where the gun causes small recoil upon ignition.

It is one additional object of the invention to provide a hand held torch for igniting powdered incendiary material, that will fire without noise.

One terminal of the igniter is connected to the positive lead of the capacitor and the other match terminal is tied to the anode of the silicon-controlled rectifier. Activation of the fire switch permits trigger current to flow from the capacitor into the gate of the silicon-controlled rectifier.

The system is designed so that when the voltage on the capacitor is from 0.7 volts to 0.9 volts more than the breakdown voltage of the zener diode the gate current will be of sufficient magnitude to turn on the silicon-controlled rectifier.

DESCRIPTION OF THE PREFERRED EMBODIMENT

Figure 1:
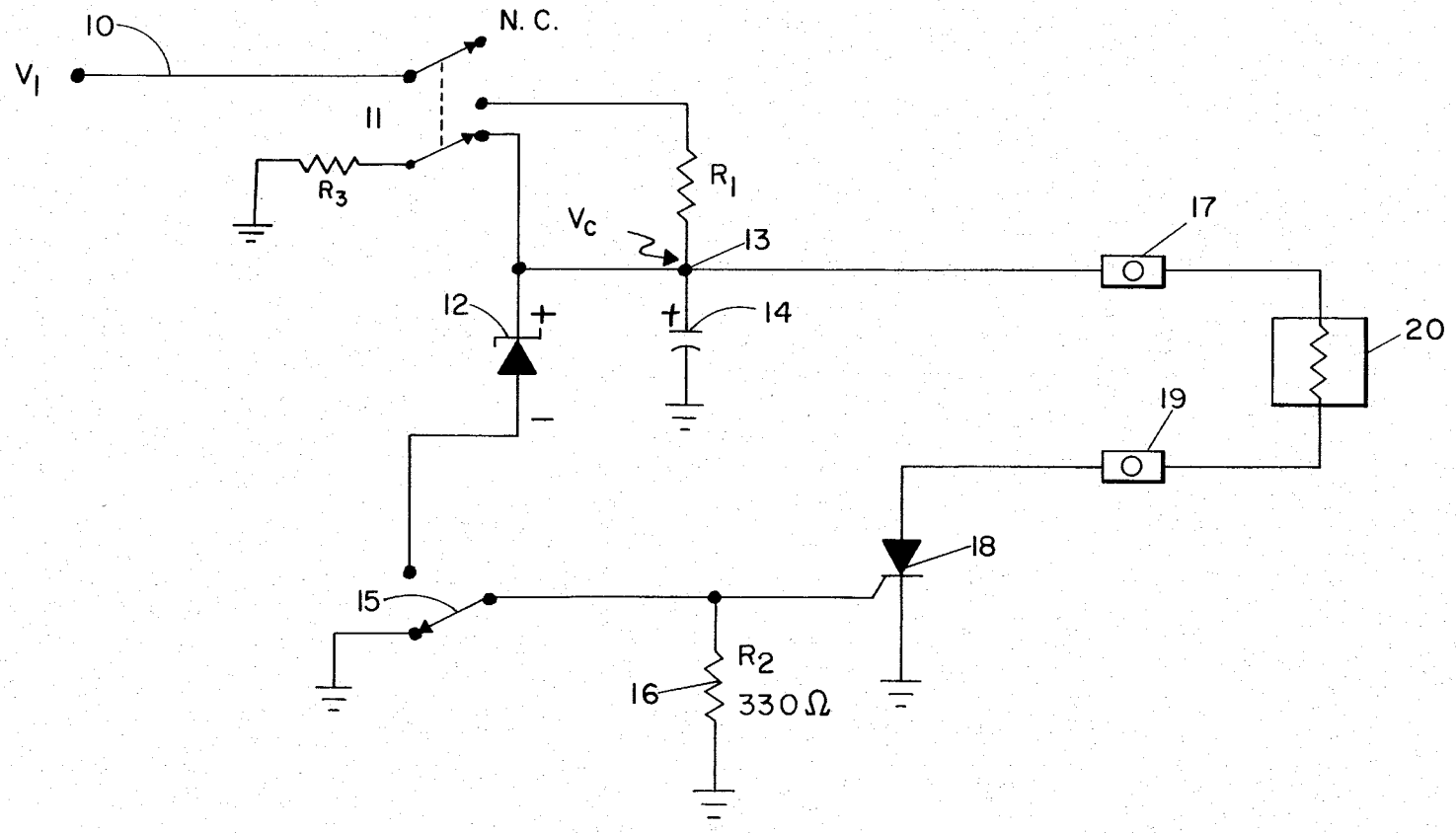
FIG. 1 is a diagram of the circuitry of the pyronol torch.

In FIG. 1 the pyro-gun or pyro-torch electronics is powered by a 12 (12.15) volt D.C. supply consisting of three four (4) volt batteries $V_1$. The energy needed to initiate the igniter of the torch is obtained from 6000 $\mu$F capacitor 14 that is charged through a resistor $R_1$ by the batteries $V_1$. The resistor $R_1$ controls the time for build up of charge on the capacitor 14. In the disclosed system a 6000 $\mu$F capacitor 14 that stores energy, in combination with a 300 ohm resistor $R_1$ allows a build up time about 8 seconds. A resistance value should be selected that allows a time build up of from about 5 seconds to about 15 seconds.

The safety features are illustrated as follows:

The arming of the torch is accomplished by a double pole double throw momentary contact toggle arm switch 11. In its normal position the arm switch 11 shorts the positive lead of the capacitor 14 to ground through a 1Ω resistor $R_3$. This eliminates any residual charge on the capacitor 14 that might unintentionally cause torch ignition. The toggle switch 11 in its normal position disconnects the positive battery pack lead 10 from the torch electronics.

The fire switch 15 is a single pole double throw push button switch. In its normal position, the fire switch 15 shorts the gate of the silicon-controlled rectifier 18 to ground and prevents current to flow to the igniter 20.

EXAMPLE

During a typical pyro-torch firing sequence the arm switch 11 is first manually engaged. At that time, the capacitor 14 begins to charge up at a rate specified by the formula, voltage on the capacitor 14 equals voltage on the battery minus voltage on the battery to the exponential power minus T divided by resistance times the capacitance. In this system when V equals 12.15 volts, R, equals 300 ohms and C equals 6000 $\mu$F. The fire switch 15 will not be effective unless the arm switch 11 is actuated for at least 8 seconds.

In the present system the capacitor 11 must charge to 11.9 volts before the silicon-controlled rectifier gate turn on voltage of 0.8 is reached. The zener diode 12 prevents the silicon-controlled rectifier from turning on before the capacitor 14 has been fully charged. One end of the second resistor R2 is connected to the gate terminal 18 of the silicon rectifier and the other end of the resistor R2 is connected to ground. The second resistor $R_2$ also draws enough current so that if the arm switch 11 and fire switch 15 are depressed simultaneously the unit will not deliver current to the ignitor 20.

Figure 2:
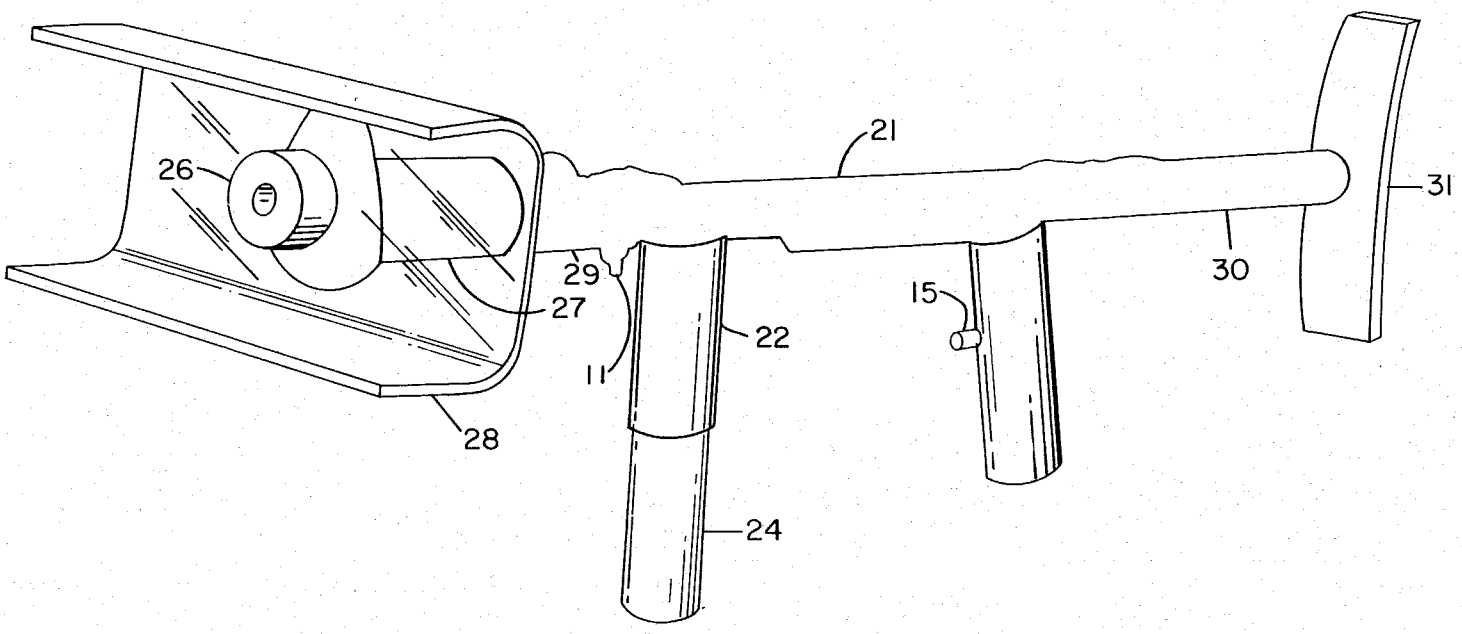
FIG. 2 is a perspective view of the pyronol torch.

In FIG. 2, the gun or torch has a forward end 26 where a flame is emitted and a rearward end 30 that may be fitted with a shoulder piece 31. The chamber for storage of powdered incendiary material 27 is in direct contact with the igniter element 20 that may be a resistance wire or equivalent commercial igniter that is capable of igniting a powdered incendiary material.

The power circuit referred to above consists of a plurality of batteries $V_1$ that may be stored in one handle 24. These batteries, that in the preferred embodiment, may be part of a 12 volt system. The batteries $V_1$ are located in the handle 24 of the gun and are switched in parallel to the series connection of the capacitor 14 and the timing resistor $R_1$.

In the secondary circuit the fire switch 15 and the zener diode 12 are in series and are connected between the positive capacitor lead and the SCR gate.

The capacitor 14 is charged by the power circuit and discharged by the secondary circuit.

Six way binding posts 17 and 19 are commercially available connectors.

A trigger circuit is comprised of zener diode 12, a resistor $R_2$ and the fire switch 15.

Obviously, many modifications and variations of this invention are possible in the light of the above teachings. It is, therefore, to be understood that within the scope of the appended claims the invention may be practiced otherwise than as specifically described.

What is claimed and desired to be secured by Letters Patent of the United States is:

1. An electrically operated pyrotechnic torch comprising an igniter and power source wherein, the power source is in a first power circuit with means to control current flow to an energy storage unit including a safety feature with means to discharge the energy storage unit to prevent inadvertent firing and a secondary circuit with an igniter in combination with means to control flow of current to the igniter and a separate trigger circuit.

2. The pyrotechnic torch of claim 1 wherein the energy storage unit is a capacitor.

3. The pyrotechnic torch of claim 1 wherein the first power circuit includes a storage battery an arming switch, timing resistor capacitor, and zener diode.

4. The pyrotechnic torch of claim 3 wherein the capacitor buildup is controlled by a resistor.

5. A pyrotechnic torch comprising a forward end with nozzle communicating with a chamber for storage of powdered incendiary material and a rearward end fitted with a shoulder piece and a connected handle means between the shoulder piece and the forward end wherein an arm switch and fire switch are mounted on the connecting elements, a power circuit consisting of a power source and energy storage unit with combined current storage element and capacitor with storage function means, including a safety feature with means to discharge the energy storage unit to prevent inadvertent firing and a power means to control current flow to the energy storage unit and a secondary circuit including an igniter device, silicon control rectifier and a separate trigger circuit.

6. The pyrotechnic torch of claim 5 wherein the current storage element is a capacitor.

7. The pyrotechnic torch of claim 5 wherein the capacitor storage function means is controlled by a resistor in series with the capacitor.

8. The pyrotechnic torch of claim 5 wherein two sequential switches closures are used to prevent inadvertent firing with a first switch that is closed for a minimum time (arming delay) before a second switch is closed for an immediate fire.

9. The pyrotechnic torch of claim 5 with means to provide an arming delay mechanism that allows a delay of 5–15 seconds.

* * * * *